US009396673B2

(12) United States Patent
Bort

(10) Patent No.: US 9,396,673 B2
(45) Date of Patent: Jul. 19, 2016

(54) SOLAR-POWERED SWOOPER/BANNER FLAGPOLE

(76) Inventor: Bruce Frank Bort, Lemont, IL (US)

( * ) Notice: Subject to any disclaimer, the term of this patent is extended or adjusted under 35 U.S.C. 154(b) by 299 days.

(21) Appl. No.: 13/462,475

(22) Filed: May 2, 2012

(65) Prior Publication Data

US 2012/0281391 A1 Nov. 8, 2012

Related U.S. Application Data

(60) Provisional application No. 61/518,403, filed on May 5, 2011.

(51) Int. Cl.

| | |
|---|---|
| ***G09F 17/00*** | (2006.01) |
| ***G09F 27/00*** | (2006.01) |
| *G09F 13/22* | (2006.01) |

(52) U.S. Cl.

CPC ..... *G09F 17/00* (2013.01); *G09F 27/007* (2013.01); *G09F 2013/222* (2013.01)

(58) Field of Classification Search

CPC ..... Y02E 10/50; Y02E 10/47; H01L 31/0422; H01L 31/042; Y02B 10/12; F21S 9/037; F21S 9/035; F21Y 2101/02; G09F 13/02; G09F 17/00; G09F 13/00; G09F 13/16; G09F 2013/0431; G09F 2013/222; G09F 27/007; A63B 2207/02; A63B 57/0056; F21W 2131/10; F05B 2220/708

USPC ..... 136/244, 251, 246; 362/183, 431, 191, 362/192, 253, 276, 806; 320/101; D26/67; 116/173; 473/176

See application file for complete search history.

(56) References Cited

U.S. PATENT DOCUMENTS

| | | | | |
|---|---|---|---|---|
| 5,273,062 | A * | 12/1993 | Mozdzanowski | 135/16 |
| 6,060,658 | A * | 5/2000 | Yoshida et al. | 136/243 |
| 6,573,659 | B2 * | 6/2003 | Toma et al. | 315/149 |
| 2002/0134297 | A1 * | 9/2002 | Moye | G09F 17/00 116/173 |
| 2004/0083633 | A1 * | 5/2004 | Mueller | 40/541 |
| 2007/0089338 | A1 * | 4/2007 | Barnhouse et al. | 40/604 |
| 2007/0220790 | A1 * | 9/2007 | Wagter | 40/218 |
| 2008/0013306 | A1 * | 1/2008 | Guilmette | 362/183 |
| 2009/0147504 | A1 * | 6/2009 | Teeters | 362/153 |
| 2010/0160057 | A1 * | 6/2010 | Willett | 473/176 |
| 2012/0017822 | A1 * | 1/2012 | Bort | G09F 13/16 116/173 |
| 2012/0113625 | A1 * | 5/2012 | Werner et al. | 362/183 |

* cited by examiner

*Primary Examiner* — Stephen F Husar
*Assistant Examiner* — Danielle Allen
(74) *Attorney, Agent, or Firm* — Dillis V. Allen, Esq.

(57) ABSTRACT

A solar powered flagpole including a stationary base and a rotatably attached pole carrying a banner or flag illuminated by a plurality of light emitting diode (LED) lights in the pole powered by an annular array of photocells carried by the rotatable pole so the photocells are powered by sun power regardless of the rotational position of the banner and pole.

11 Claims, 14 Drawing Sheets

SOLAR-POWERED SWOOPER/BANNER FLAGPOLE

BACKGROUND OF THE INVENTION

Sports fans, business owners, governments, and other use solar powered banner and flagpole assemblies to show team pride, advertising products and brands or promoting fairs, holidays, special events, etc. Having lights inside or attached to the flagpole illuminates the flags and/or banners which draws attention and allows them to be seen at night. The invention allows for an energy efficient and inexpensive way of illuminating flags and banners. The way the flags and banners are placed over the solar powered banner and flagpole assembly allows very little to no light pollution, just an appealing visual of an illuminated flag or banner. Another benefit is that they can be changed easily. This is ideal for companies that change advertising campaigns often, and for seasonal holiday decorating and sports that change throughout the year.

SUMMARY OF THE PRESENT INVENTION

According to the present invention, a solar powered flagpole is provided that includes a stationary base and a rotatably attached pole carrying a banner or flag illuminated by a plurality of light emitting diode (LED) lights in the pole powered by an annular array of photocells carried by the rotatable pole so the photocells are powered by sun power regardless of the rotational position of the banner and pole.

Furthermore, the flagpole assembly is provided with a plurality of bearings to promote swiveling and spacers are provided to fasten the banner for better illumination.

The flagpole assembly can also be mounted horizontally on a fixed vertical support.

Other aspects of the present invention will appear more clearly from the following detailed description.

DETAILED DESCRIPTION OF THE PREFERRED EMBODIMENT

As noted above, the present invention relates to a banner or flagpole assembly that has certain rotatable elements to facilitate the illumination of the banner or flag.

While the display item; i.e., the banner or the flag, is defined herein as a flexible display item that may be either a flag or a banner. A flag is generally a flexible graphic material that designates a place of origin, such as a country, county, city, or neighborhood, while a banner is usually a graphic display to advertise a particular event or product, such as an automobile dealer's offerings or rock band events.

Figure 1:
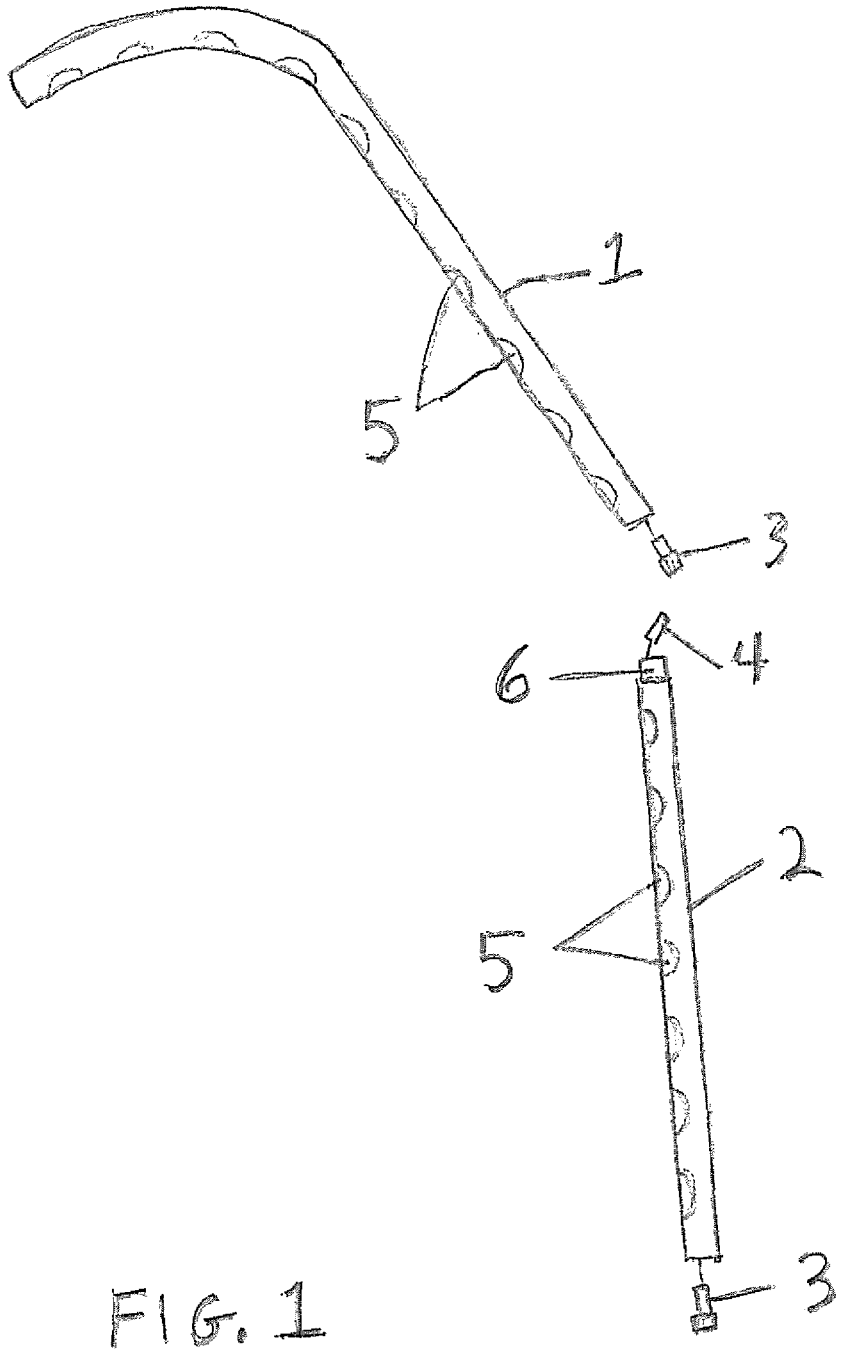
FIG. 1 shows two sections of a solar powered banner and flagpole assembly.
Figure 2:
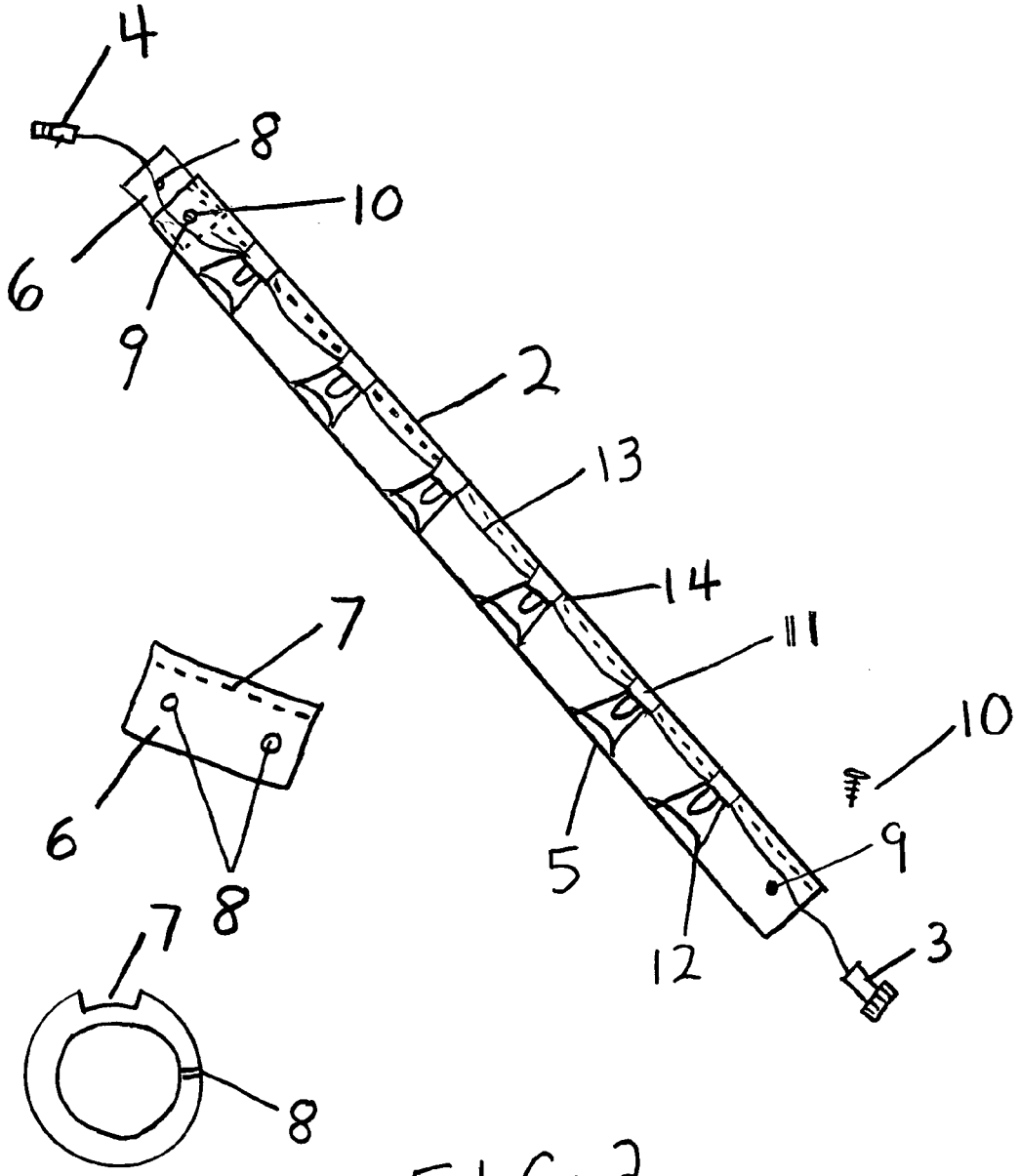
FIG. 2 shows the inside of a section of a solar flagpole and two views of a connector.
Figure 3:
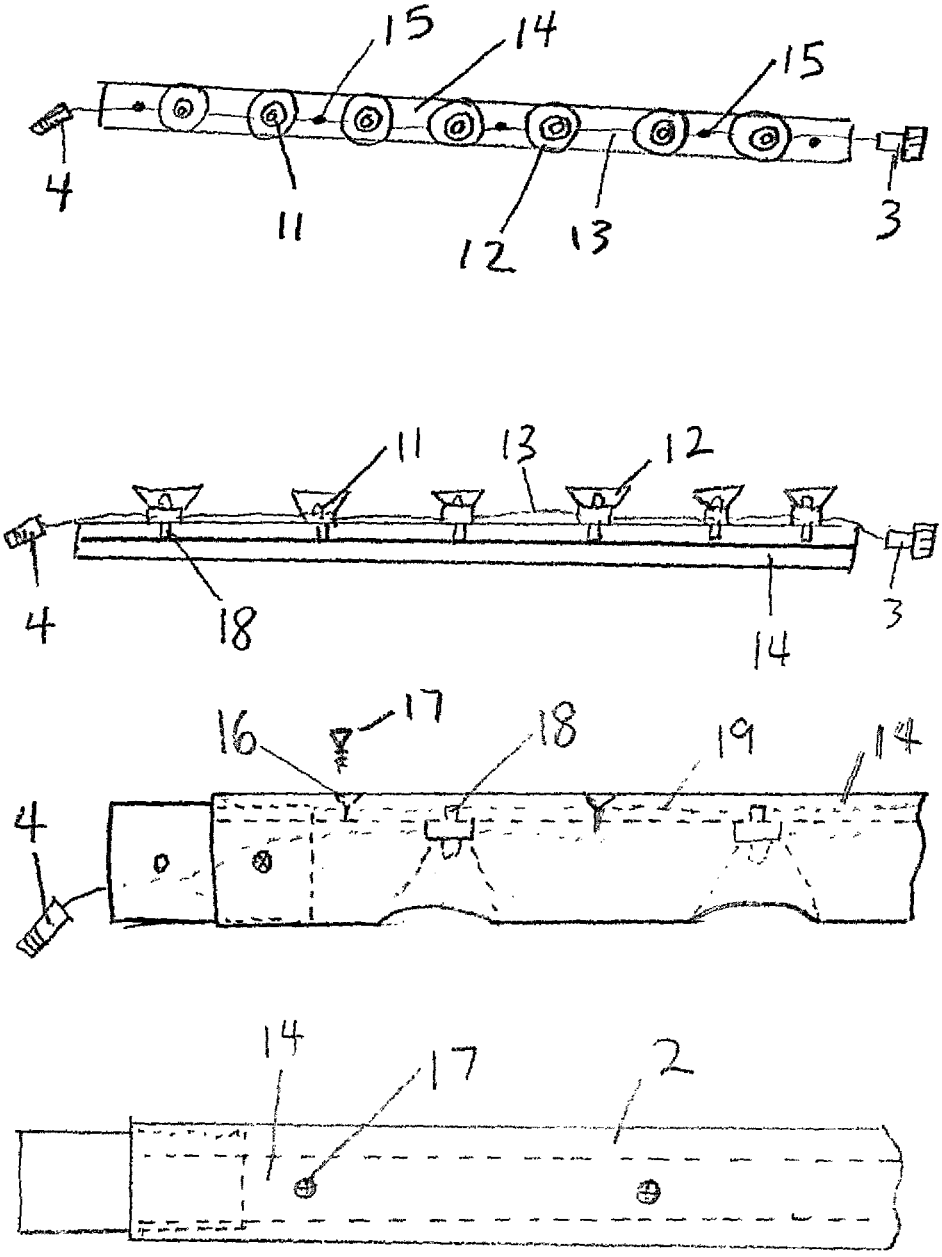
FIG. 3 shows a section of a solar powered banner and flagpole assembly and a strip of plastic made for attaching the LED lights to the inside of the flagpole.
Figure 4:
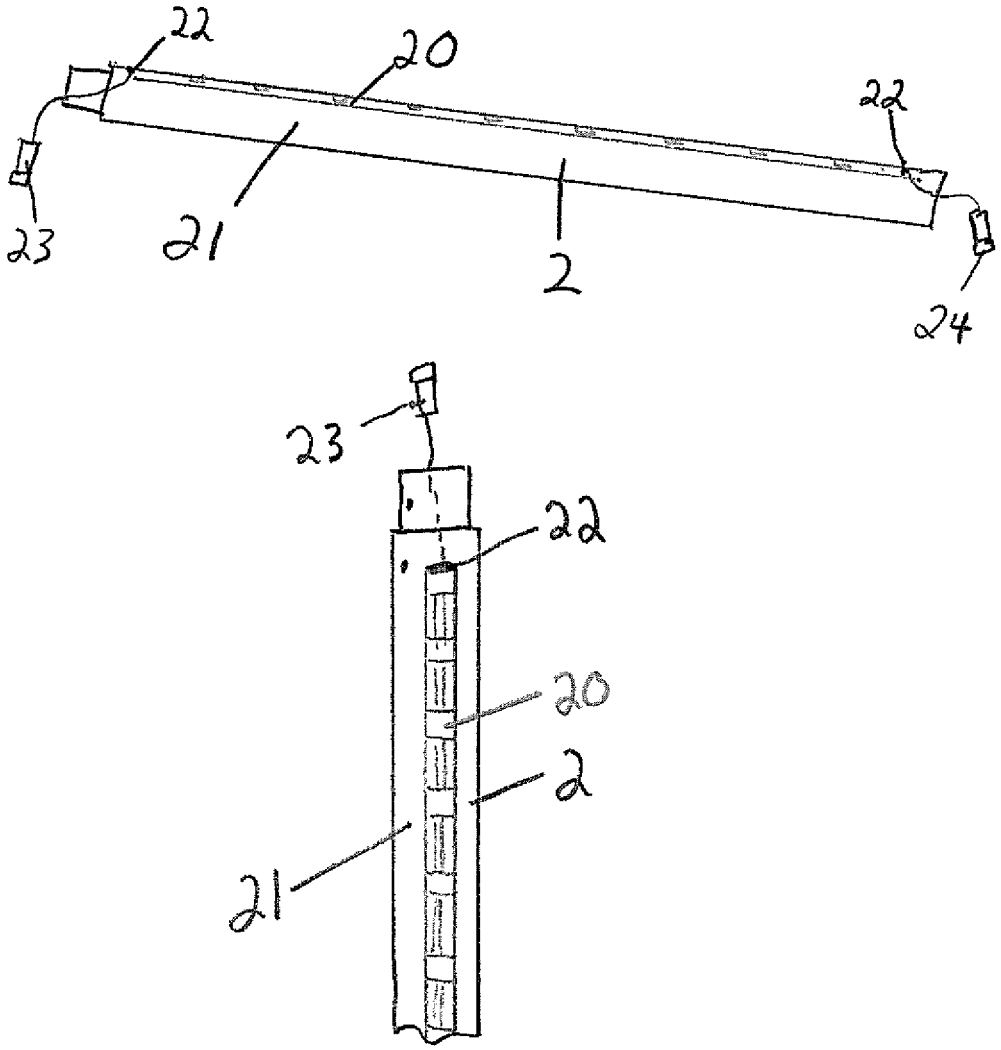
FIG. 4 shows a section of a solar powered banner and flagpole assembly with stick-on light emitting diode (LED) lights that come on a roll and have adhesive on them like a roll of tape.

Referring to FIG. 4, #20 shows light emitting diode (LED) lights that come on a roll (like tape) with adhesive on the back for attaching to other material. See #20 attached to #2 and see #22 a hole where the plug ends of #20 the (LED) tape/adhesive strip goes into the inside of #2 and the female clip #23 and the male clip #24 come out at the ends of the banner-flagpole section so when they are connected, they are protected from being pulled apart or damaged. #21 shows a clear plastic film/shrink wrap that can be put over #2 to secure the attachment of #20 (LED tape) and seal the holes #22. The plastic film/shrink wrap can be heated for a tight seal. This method of sealing could be used with the other type of Led light insertion into the flagpole as shown in FIG. 2 and FIG. 3.

Figure 5:
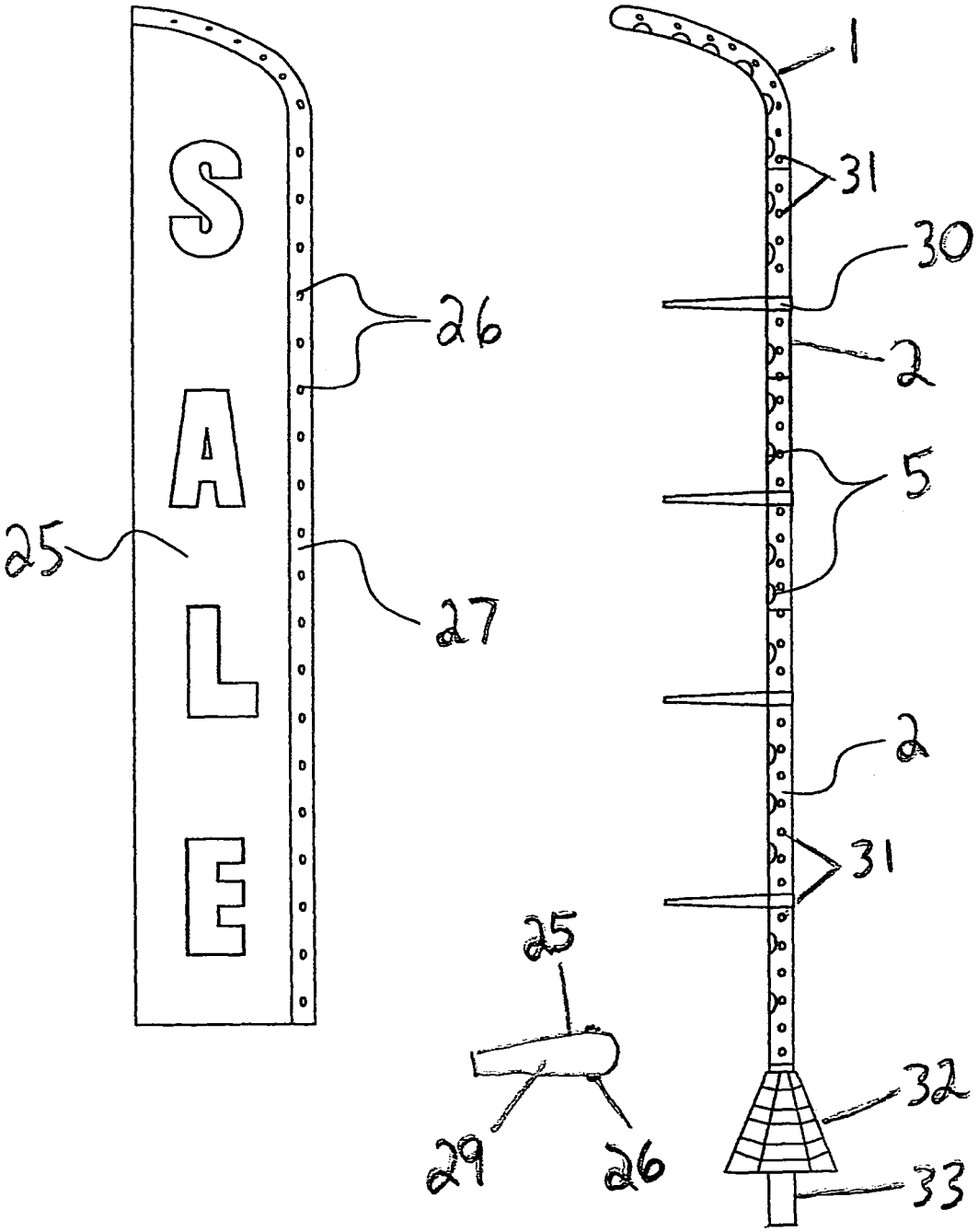
FIG. 5 shows a solar powered banner and flagpole assembly with a swooper/banner flag on it.

Referring to FIG. 5, #25 is a solar-powered banner and flagpole assembly that has female snaps #26 that are attached to #27 the border/edge of the banner-flag which is made to slip over a banner-flagpole and snap onto #31 the male snaps running the length of the banner-flagpole. #29 shows the bottom opening of #25 where it slips over the banner-flagpole. #30 is a spacer made to keep a space inside the banner-flag for illumination. #32 is a rotating solar unit attached to the bottom section of a banner-flagpole.

Figure 6:
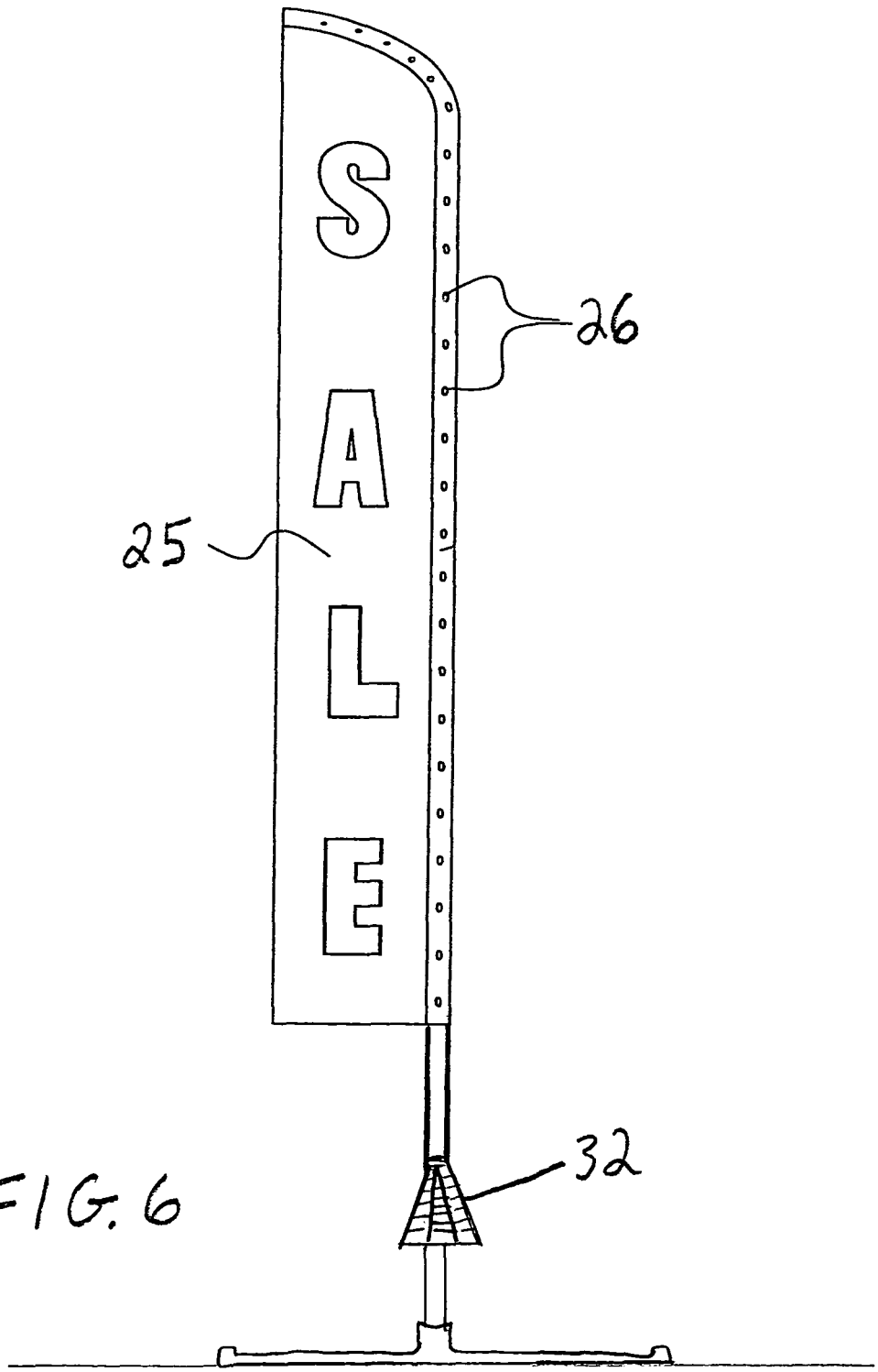
FIG. 6 shows a solar powered banner and flagpole assembly assembled and displaying a flag/banner.

FIG. 6 shows #25 a banner-flag snapped and displayed on a fully assembled solar-powered banner-flagpole.

Figure 7:
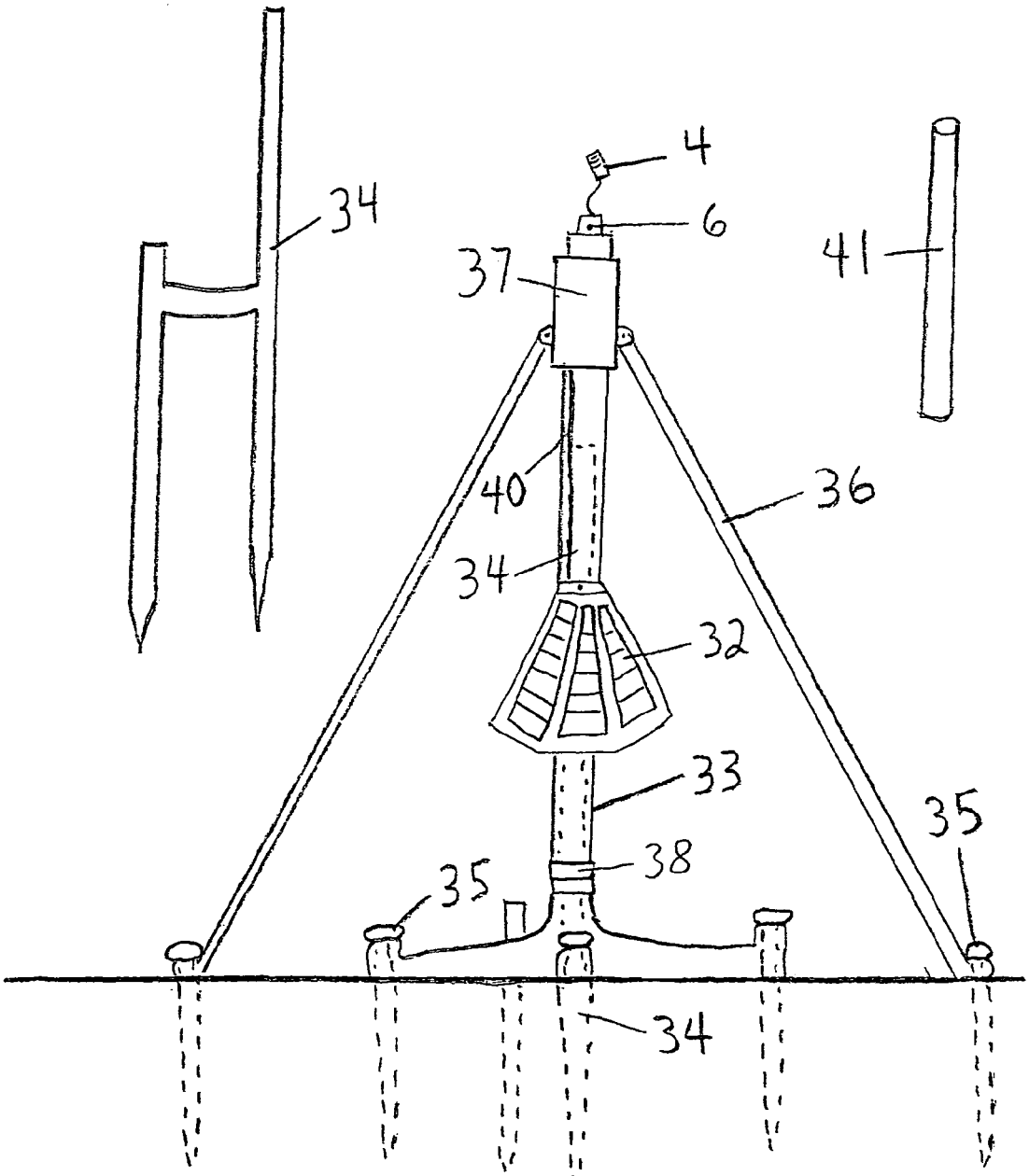
FIG. 7 shows a solar powered banner and flagpole assembly on a flagpole spike/base with a four-legged stabilizing support stand.

Referring to FIG. 7, #34 shows a common two-prong spike for a banner-flagpole. #39 shows a four-legged base stand that slips over #34 to help stabilize and secure it in place in the ground. #37 shows a sleeve that slips over #33 the bottom section of a solar-powered banner-flagpole. #37 can have bearings in it with the inside being the race side. #36 shows one of the four legs that attach with screws or rivots to the outside of #37 and are secured to the ground with #35 ground spikes. #38 is a bearing sleeve with #33 resting on top of #38 which is the race end of #38 allowing #33 to spin freely. When referring to #37 and #38, they could be made with or without bearings. #38 could be replaced by just a couple of smooth washers. #40 is the wire that comes out of the rotating solar unit #32 which goes on the outside of #33 until it gets near the top and passes where #34 reaches inside of #33. Then #40 goes inside of #33 and through #6 the connector at the top end of #33 and is attached to #4 the male wire connector that attaches the light emitting diode (LED) lights to the rest of the solar-powered banner-flagpole. #41 is a thin sleeve that can go over #33 and #40 from the top of #32 the solar unit until a short distance past where #40 goes back into #33 so that #41 can protect #40. Another option would be that #40 could have a thin plastic tube that goes over it for protection. There are many types of base/stands on the market that could work with a solar-powered banner-flagpole. Since solar-powered banner-flagpoles have slight extra weight, some stands and bases may need to be a bit larger or reinforced with a four-legged support stand/sleeve. See #37 and #36. A minimum diameter of a solar-powered banner-flagpole should be approximately 2 inches, for which some stands may require an additional sleeve or to be made slightly larger.

Figure 8:
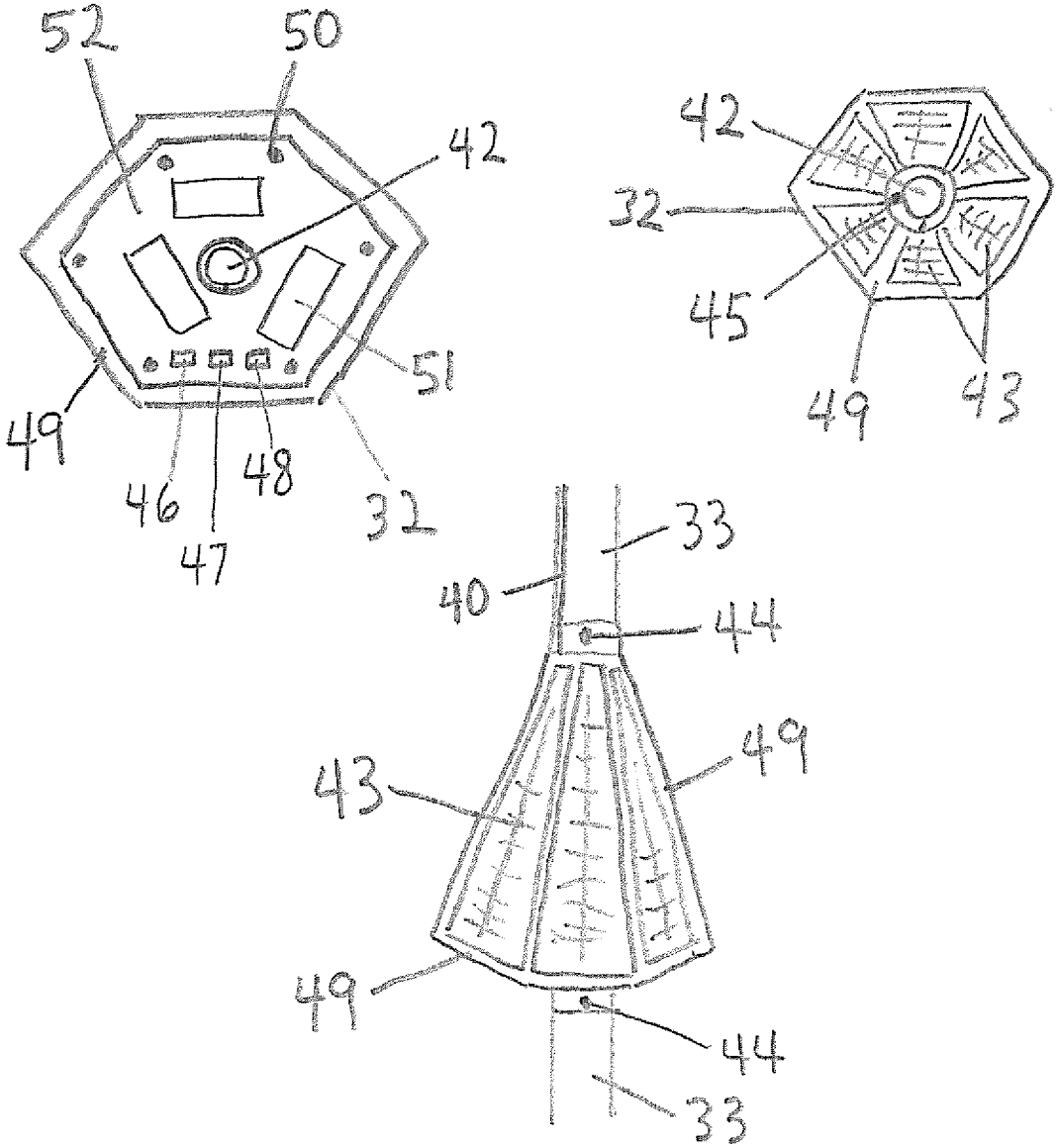
FIG. 8 shows three views of a rotating solar unit (top, bottom, side).

As seen in FIG. 8, the solar cell array 32 contains a plurality of trapezoidal solar cells 43 extending completely around the angular array 32 also as seen in the exploded FIG. 8.

Figure 9:
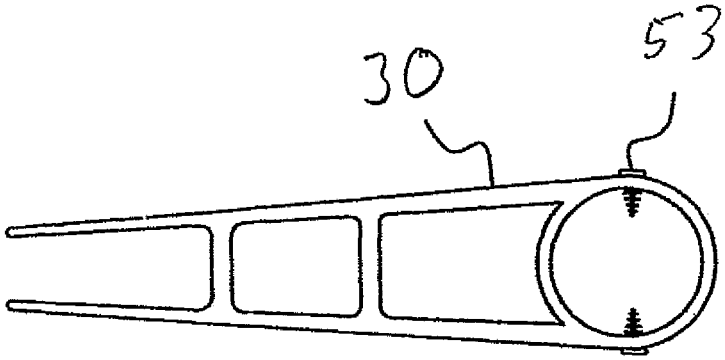
FIG. 9 shows a plastic spacer for keeping a space in between the two faces of a flag or banner.

FIG. 9 includes an aluminum extrusion 30 over which the flag or banner extends so that the interior of the flag assembly may be illuminated.

Figure 10:
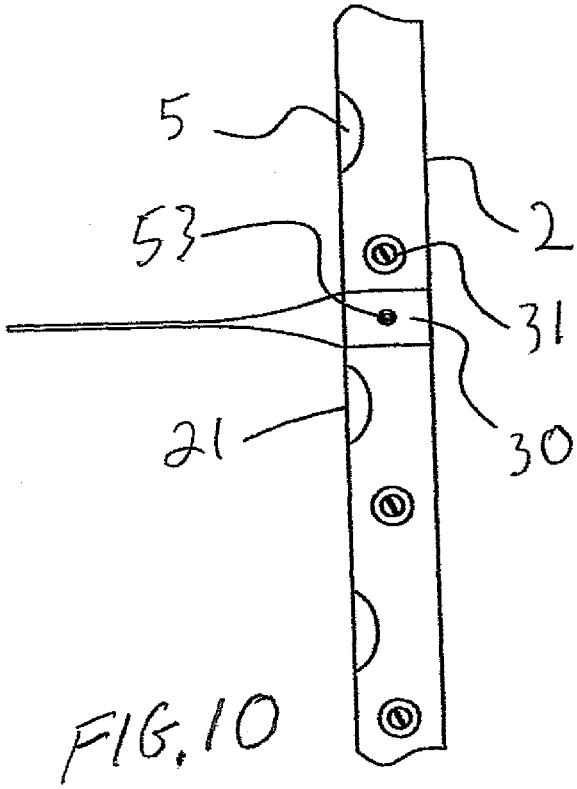
FIG. 10 shows a side view of a section of a solar powered banner and flagpole assembly with a plastic spacer.

In FIG. 10, the pole assembly 33 is shown in two pieces with screws 30 and 31 attaching the pieces together and light elements 5 and 21 shown.

Figure 11:
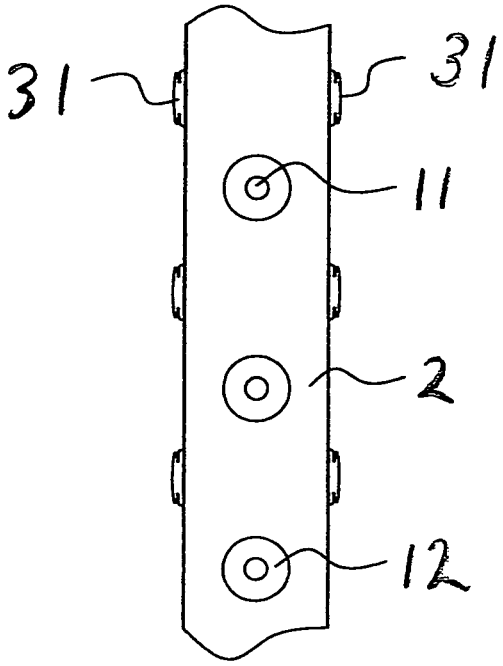
FIG. 11 shows a front view of a section of a solar powered banner and flagpole assembly.
Figure 12:
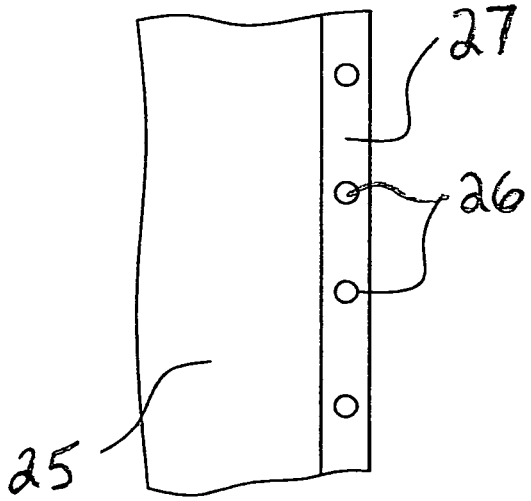
FIG. 12 shows a flag or banner with snaps.

In FIGS. 11 and 12, flag or banner no is shown wrapped around pole assembly 33 so that the LEDs 11, 12 and 31 illuminate the interior of the dual layered flag no.

As seen in FIG. 2, the LEDs 5, 12, and 14 are shown positioned to illuminate the interior of the flag and are directed to the distal end of the flag or banner for more complete illumination.

Referring to FIG. 9, #30 is a plastic spacer for keeping a space inside a banner or flag for illumination. #53 shows a screw and hole for attaching #30 to the sections of a solar-powered banner-flagpole.

FIG. 10 shows a side view of #2 a section of a solar-powered banner-flagpole with #30 attached with #53 the screw and #31 a male snap attached also with a screw. #21 shows plastic film/shrink wrap attached to cover the outside of the flagpole.

FIG. 11 shows a front view of #2 a section of a solar-powered banner-flagpole with #11 and #12 light emitting diode (LED) lights and reflectors directed outward toward where a banner or flag are secured for illumination.

FIG. 12 shows #25 a side view of a banner-flag with #27 the border and #26 the female snaps.

Figure 13:
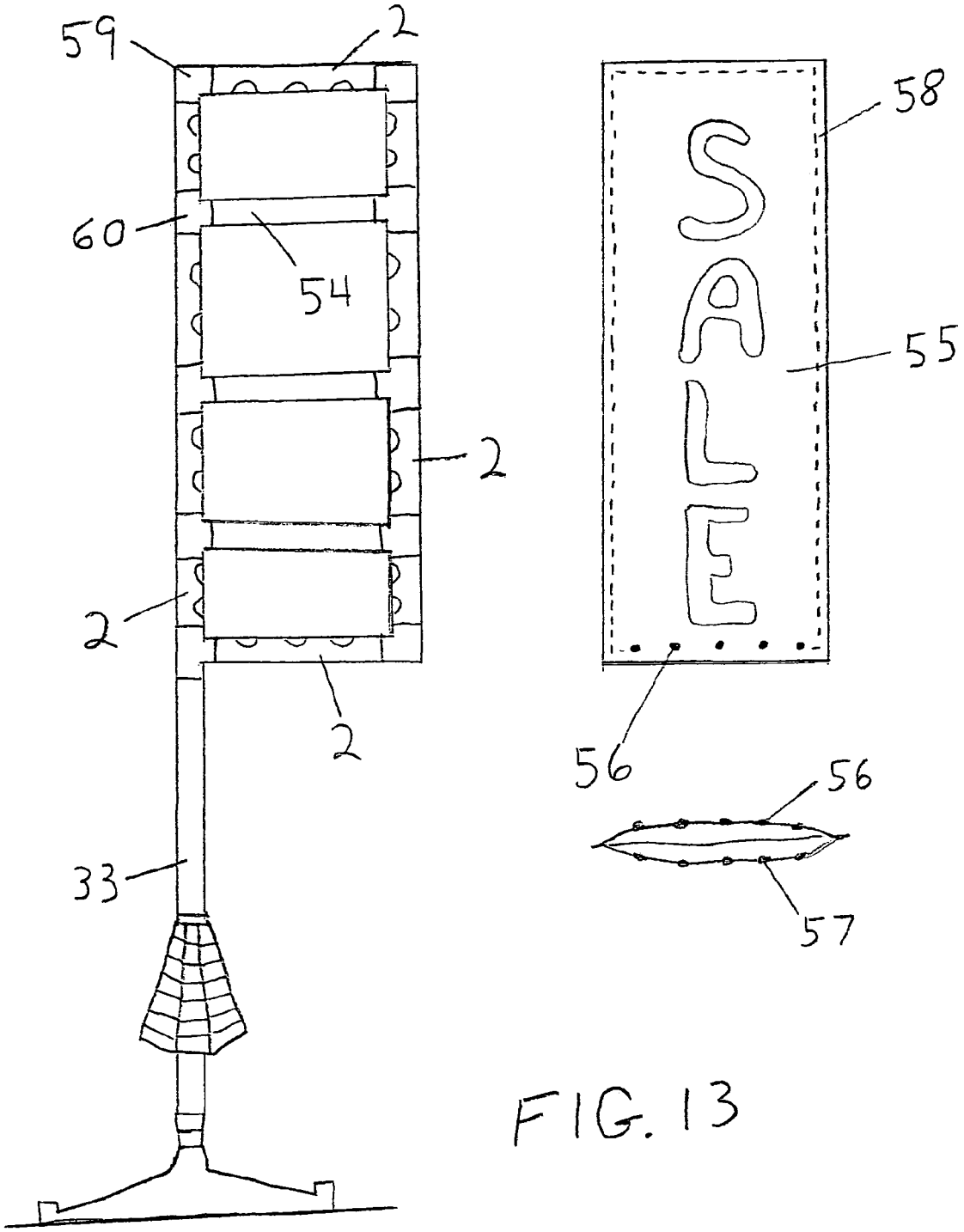
FIG. 13 shows a solar powered banner and flagpole assembly with a frame that goes all the way around the inside of the flag/banner and a flag/banner with two faces made to slide over the flag/banner flagpole.

FIG. 13 shows a solar-powered banner and flagpole assembly with a frame connecting sections #2 on four sides with the use #59 corner couplings and #60 T-couplings. #54 shows clear thin plastic tubes being used for spacers. They go into #60 and keep the space inside #55 a banner/flag. #58 shows stitching for attaching two banners or flags together for sliding over a solar-powered banner and flagpole assembly. #56 are male snaps. #57 are female snaps. Snapping #56 and #57 together secures the banner/flag on the solar-powered banner and flagpole assembly. Using 8 mil. or 13 mil. Commonly used polyethylene or vinyl banner material with the inside or back of it being high gloss white enhances the reflectability and illumination. The banners/flags can be made of commonly used materials such as polyethylene, vinyl, nylon, cotton, polyester, etc. They all must be somewhat or very translucent.

Figure 14:
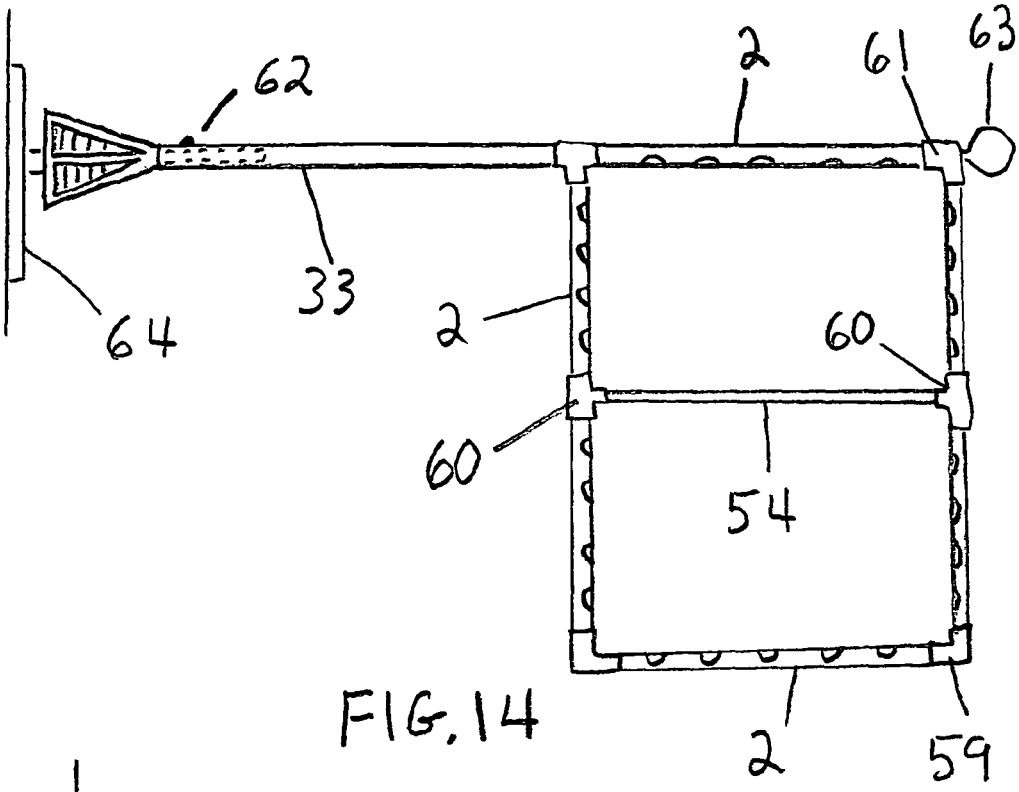
FIG. 14 shows a solar powered banner and flagpole assembly with a rotating solar unit and is wall-mounted.

FIG. 14 shows a solar-powered banner and flagpole assembly that is wall-mounted or horizontally displayed. It is made using #59 and #60 to attach the #2 sections together. #54 is thin clear spacer for keeping space inside the banner/flag. The snaps on a banner or flag can be put on different sides to accommodate the style of the solar-powered banner and flagpole assembly. #61 is a corner coupling with #63 a flagpole attached/screwed on. #61 would be similar to #59 but have a male screw end or a small piece made to receive #63. #62 is a screw that goes through #33 and into a slot/groove in #64 the base for wall mounting or horizontal mounting. As with all solar products, having them in an area that gets plenty of sun is necessary. Walls facing north in the U.S. may not work well.

Figure 15:
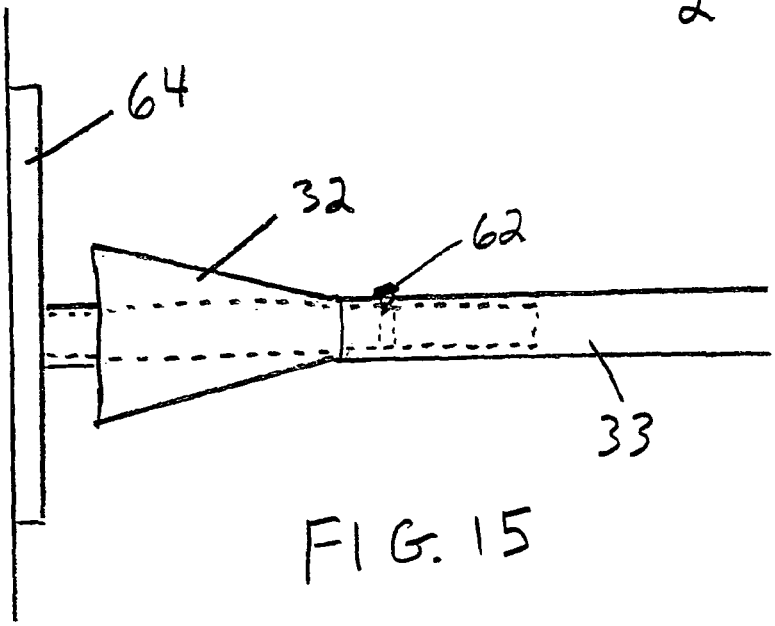
FIG. 15 shows a bottom of a flag/banner flagpole with a wall-mounted base.

FIG. 15 shows a close-up view of a solar-powered banner and flagpole assembly on #64 a base with #62 holding it from sliding off.

Figure 16:
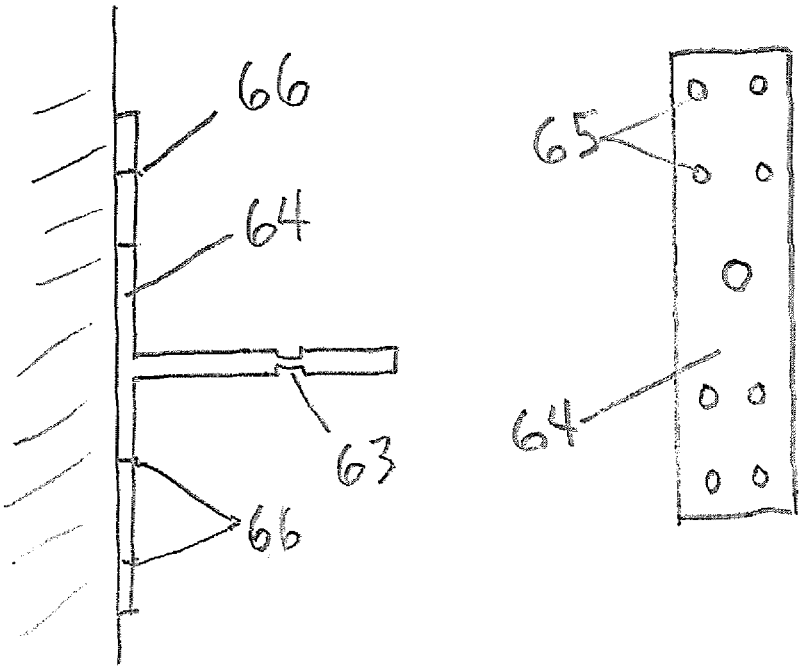
FIG. 16 shows a wall-mount base for a solar powered banner and flagpole assembly.

FIG. 16 shows a side view and a front view of #64 a wall-mounted/horizontal mount for a solar-powered banner and flagpole assembly. #63 is a slot/groove that #62 goes in, but #62 is made to still allow the solar-powered banner and flagpole assembly the ability to spin on #64 the base. #65 shows holes in #64 for attaching to a wall or post. #66 shows screws that attach #64 to a wall.

Figure 17:
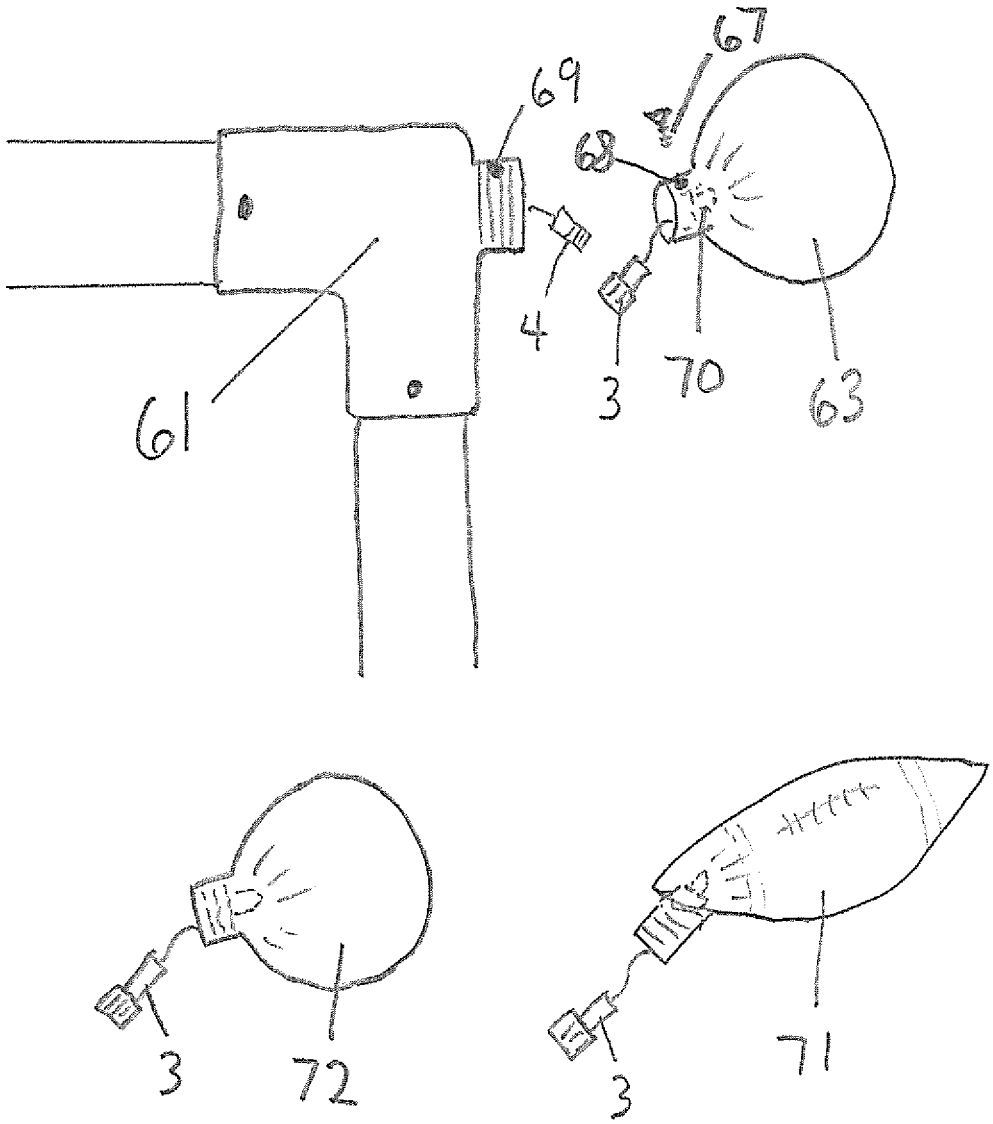
FIG. 17 shows the corner of a wall-mounted solar flagpole with a flagpole topper that can be illuminated and match/complement the theme of the flag or banner.

FIG. 17 shows #63 a flagpole topper that can be made of translucent plastic and have #70 and LED lights inside for illuminating it. #63 can attach by screwing it onto #61 and held in place with #67 a screw that goes through #68 a hole in #63 and into #69 a hole in #61. #4 a male wire connector and #3 a female wire connector connects #70 to the solar unit. #71 shows a translucent football that can be attached to #61. #72 shows a translucent ball that could be made to look like a sports ball of different types by changing its colors. The toppers could have a large variety of shapes and themes to complement or enhance a banner or flag being displayed.

While the present invention has been described with respect to several different styles or options, it will be appreciated that many modifications and variations may be made without departing from the spirit and scope of the invention. It is, therefore, the intent of the appended claims to cover all such modifications and variations which fall within the spirit and scope of the invention.

What is claimed is:

1. A flagpole assembly including a stationary base, a tubular pole assembly freely rotatably mounted on the base carrying a banner, said banner having a translucent sleeve portion, a plurality of light emitting diode lights (LED) said pole assembly for illuminating the banner, and an annular array of photocells on the pole assembly positioned to absorb sunlight in different angular orientations of the pole and the banner, said pole assembly including an upper section and a lower section, said annular array of photocells being fixed to the lower section and having a frusto-conical shape and freely rotatable with the pole assembly, said translucent sleeve portion is mounted over a portion of the pole assembly for enhancing illumination of the banner.

2. The flagpole as defined in claim 1 including a plastic spacer made to attach to the flagpole to keep a space adjacent the banner for improved illumination.

3. The flagpole as defined in claim 1 with the pole assembly including a frame of tubular sections with light emitting diode (LED) lights inside the tubular sections and having them connected in a rectangular shape with the light emitting diode (LED) lights in a top vertical section and the light in a bottom vertical section facing one another, and the light emitting diode (LED) lights in two horizontal frame sections facing one another.

4. The flagpole in claim 1 and a clear plastic tube passing through an inside area of the flagpole frame and connected to the frame on its ends, said clear plastic tube keeping a space between the top section and the bottom section.

5. A flagpole as defined in claim 3 and having the top sections that contain the light emitting diode (LED) lights being made of a clear plastic tube.

6. A flagpole as defined in claim 1 and a light emitting diode (LED) light strip with adhesive on the back and applied to a top section of the flagpole.

7. A flagpole in claim 3 and being wall mounted and secured with a wall mount made with a rod for receiving or having the bottom section of the flagpole slipped over it, said wall mount having a groove for securing the flagpole with a screw.

8. A flagpole as defined in claim 1 wherein said pole assembly includes a top that is translucent and has a light inside it for illumination, said light being connected to the solar unit for illumination, said top being attached on a corner end of a flagpole.

9. A flagpole as defined in claim 1 and a bearing sleeve that is slid over a flagpole, spike, or base and the flagpole rests on it, and the bearings allow the flagpole to spin easily.

10. A flagpole as defined in claim 1 and a bottom section with a bearing sleeve attached to the very bottom, allowing the flagpole to spin easily.

11. A solar powered banner and flagpole assembly including a stationary base and a freely rotatably attached pole carrying a banner or flag illuminated by a plurality of light emitting diode (LED) lights in the pole powered by an annular array of photocells carried by the rotatable pole so the photocells are freely rotatable and powered by sun power regardless of the rotatable position of the banner and pole, said solar cells going 360 degrees around the unit that contains batteries attached to a pole assembly shaft by allowing them to pass through a hole or opening in the center of the rotating solar unit, said solar cells being attached to the pole assembly and if the pole spins, it will still collect solar energy and charge the batteries and the charged batteries can be used for powering a device or product needing a battery to operate or power it, said annular array of photocells having a frusto-conical shape, said banner having a translucent sleeve portion, wherein the translucent sleeve portion is mounted over a portion of the pole assembly for enhancing illumination of the banner.

* * * * *